US008601914B2

(12) United States Patent
Miller

(10) Patent No.: US 8,601,914 B2
(45) Date of Patent: Dec. 10, 2013

(54) METHOD AND APPARATUS FOR ADAPTING A SOCKET WRENCH

(76) Inventor: Anthony Miller, London, KY (US)

( * ) Notice: Subject to any disclaimer, the term of this patent is extended or adjusted under 35 U.S.C. 154(b) by 317 days.

(21) Appl. No.: 13/042,509

(22) Filed: Mar. 8, 2011

(65) Prior Publication Data

US 2012/0227551 A1 Sep. 13, 2012

(51) Int. Cl.
*B25B 23/16* (2006.01)

(52) U.S. Cl.
USPC ..... 81/177.85; 81/177.5; 7/100

(58) Field of Classification Search
USPC ..... 81/177.5, 177.85; 7/100
See application file for complete search history.

(56) References Cited

U.S. PATENT DOCUMENTS

| | | | | |
|---|---|---|---|---|
| 6,662,688 | B1 * | 12/2003 | Avery | 81/124.5 |
| 6,901,827 | B1 * | 6/2005 | Yen | 81/177.85 |
| 6,941,840 | B1 * | 9/2005 | Harris | 81/13 |
| 2007/0199412 | A1 * | 8/2007 | Lee | 81/177.85 |

* cited by examiner

*Primary Examiner* — Lee D Wilson
*Assistant Examiner* — Shantese McDonald
(74) *Attorney, Agent, or Firm* — Stockwell & Smedley, PSC

(57) ABSTRACT

An adapter for a socket wrench includes a shaft with two socket drivers disposed along the shaft. Each of the socket drivers can, independent from one another, rotate around the shaft and slide along the shaft in either direction. There are two stops at each end of the shaft to prevent the socket drivers from falling off the shaft. The socket drivers can be attached to a variety of different socket accessories and sockets so that torque applied to one of the socket drivers can be multiplied and exerted at the end of the other socket driver. One particular embodiment includes a shaft and pedal that aids a person in correctly and easily tightening or loosening lug nuts.

20 Claims, 6 Drawing Sheets

FIG. 7
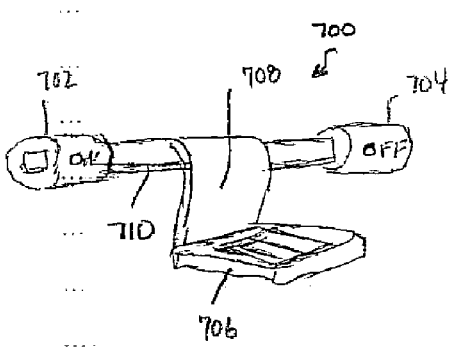
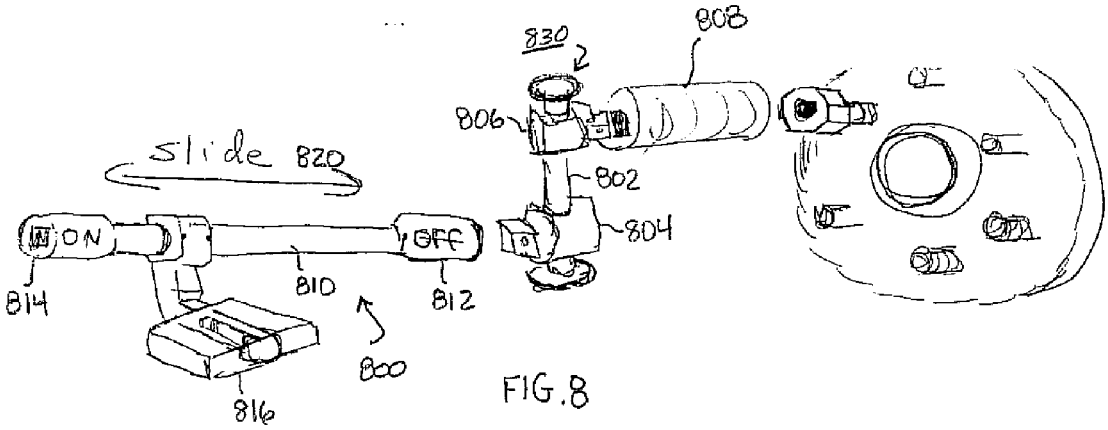
FIG. 8

METHOD AND APPARATUS FOR ADAPTING A SOCKET WRENCH

BACKGROUND OF THE INVENTION

The present invention relates generally to a hand tool and more particularly to an adapter for a socket wrench.

DESCRIPTION OF RELATED ART

A socket wrench is a wrench with a female socket or recess that grips the male head of a fastener or fitting in order to apply torque to it either to turn it or to keep it from turning. The most widespread form of socket wrench today is a hand tool version comprising a socket set with dozens of indexable sockets each for a certain size fastener head that clip onto a ratchet handle or ratchet wrench, which is a handle with a ratcheting mechanism built in. The handle provides the mechanical advantage to supply the torque by hand.

The other common form factor is a power tool version in which a socket set is used with an impact wrench. The wrench is usually powered pneumatically, although electric versions are not uncommon. Hydraulic motor versions are rare outside of heavy industry. The sockets for impact duty, called impact sockets, are made with higher bulk and strength than those for hand-tool duty. They are typically finished in black oxide rather than the chrome plating typical of the hand-tool variety.

The principal application of socket wrenches is to loosen or tighten fasteners such as nuts and bolts. The socket wrench typically is of the ratchet type. The ratcheting mechanism allows the nut to be tightened or loosened with a reciprocating motion, without requiring that the wrench be removed and refitted after each turn. Typically, a small lever on the ratchet head switches the wrench between tightening and loosening mode. The sockets are attached to the ratchet through a square fitting that contains a spring loaded ball detent mechanism to keep the sockets in place. These drive fittings come in four common sizes: ¼ inch, ⅜ inch, ½ inch, and ¾ inch (referred to as drives, as in "⅜ drive").

Sockets are available in various depths, often divided by manufacturers into two categories of "standard" and "deep." Standard, otherwise known as "shallow" sockets, have a lower profile and allow a user to access nuts in narrow spaces. Deep sockets are useful for turning nuts onto bolts when the bolt extends upwards into the socket as in the case of many bolted joints, a very typical example being exhaust clamp bolts on an automobile.

These are some of the common accessories that are used with socket wrenches:

a) Extensions, sometimes called "extender arms", allow access to nuts that are difficult to reach, typically in automotive applications.
b) A breaker bar is an extended-length handle for sockets that adds extra torque for loosening strongly tightened or frozen fasteners.
c) Universal joints are two articulated socket joints combined at a right angle, that allow a bend in the turning axis of the wrench. They are used with extensions for turning a bolt or nut at a difficult to access location.
d) Flex handles are socket wrenches in which the drive head pivots back and forth on the handle, to allow the handle to avoid obstructions when being turned in a cramped space.
e) Adapters allow sockets of one drive size to be used with wrenches of another drive size. They consist of a male drive fitting of one size attached to a female drive fitting of another size. For example, a ¼ in. to ⅜ in. adapter allows sockets with ¼ in. drive holes to attach to ⅜ in. wrenches.

Lug wrench is the name for a type of socket wrench used to turn lug nuts on automobile wheels. The form commonly found in car trunks is an L-shaped metal rod with a socket wrench on the bent end and a prying tip on the other. The prying tip is mainly intended to remove hub caps or wheel covers that may be covering a wheel's lug nuts. Another common type, sometimes known as a spider, is made in the shape of a cross, with different sized sockets on each of the four ends.

One aspect of these various wrenches is that typically the physical strength of the person using the wrench introduces a limitation into how many different uses the person can apply the wrench to. As mentioned above, a breaker bar is sometimes used to provide a torque multiplication effect. However, this typically is in the form of an extender bar that is large and unwieldy to use and to store. Thus, there remains the need for a compact, inexpensive, easy-to-use torque multiplying adapter for socket wrenches.

BRIEF SUMMARY OF THE INVENTION

Embodiments of the present invention relate to an adapter for a socket wrench that includes a shaft with two socket drivers disposed along the shaft. Each of the socket drivers can, independent from one another, rotate around the shaft and slide along the shaft in either direction. There are two stops at each end of the shaft to prevent the socket drivers from falling off the shaft. The socket drivers can be attached to a variety of different socket accessories and sockets so that torque applied to one of the socket drivers can be multiplied and exerted at the end of the other socket driver. One particular embodiment includes a shaft and pedal that aids a person in correctly and easily tightening or loosening lug nuts.

It is understood that other embodiments of the present invention will become readily apparent to those skilled in the art from the following detailed description, wherein it is shown and described only various embodiments of the invention by way of illustration. As will be realized, the invention is capable of other and different embodiments and its several details are capable of modification in various other respects, all without departing from the spirit and scope of the present invention. Accordingly, the drawings and detailed description are to be regarded as illustrative in nature and not as restrictive.

BRIEF DESCRIPTION OF DRAWINGS

Various aspects, in accordance with the principles of the present invention, are illustrated by way of example, and not by way of limitation, in the accompanying drawings, wherein:

FIG. 7 depicts a lug nut accessory for a socket wrench in accordance with the principles of the present invention.

FIG. 8 depicts an alternative lug nut accessory for a socket wrench in accordance with the principles of the present invention.

DETAILED DESCRIPTION OF INVENTION

The detailed description set forth below in connection with the appended drawings is intended as a description of various embodiments of the invention and is not intended to represent the only embodiments in which the invention may be practiced. The detailed description includes specific details for the purpose of providing a thorough understanding of the invention. However, it will be apparent to those skilled in the art that the invention may be practiced without these specific details. In some instances, well known structures and components are shown in block diagram form in order to avoid obscuring the concepts of the invention.

As for construction and materials of the embodiments of the invention described herein, a wide variety of materials can be used that are appropriate for the intended use of a particular wrench adapter. For example, different blends of stainless steel, vanadium, nickel, chromium, etc. are known to have particular operating strengths and physical limits. Thus, embodiments of the present invention are not limited by the material from which it is constructed as this material may vary for different intended uses. Also magnetized tools can be beneficial in certain circumstances. Accordingly, portions of the socket wrench adapter described herein can be augmented by being a magnet as well. This magnetization could allow the tool to be attached to different support structures or allow different bolts and nuts to be conveniently attached to the adapter.

As for size and dimensions, the following description provides exemplary sizes for illustration purposes only. While it is beneficial to have a wrench adapter that is small enough to conveniently fit in a tool box or pocket, there is no requirement that the present inventive wrench adapter be a particular size. As mentioned in the background section, there are a wide variety of sockets with various dimensions and different characteristics. Embodiments of the present invention provide an adapter to all these different types of sockets.

Figure 1A:
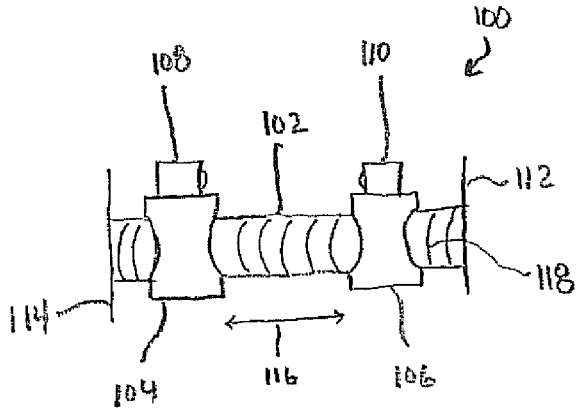
FIG. 1A depicts a socket wrench adapter in accordance with the principles of the present invention.

FIG. 1A depicts a socket wrench adapter in accordance with the principles of the present invention. The adapter 100 of FIG. 1A depicts the general structure of a socket wrench adapter in accordance with the principles of the present invention. The following figures provide variations on the general theme illustrated in FIG. 1A. There is a central shaft 102 that is generally cylindrical and solid in construction. This shaft may be exposed to significant torque during some operations and, thus, is constructed of a sturdy material (e.g., steel) to withstand such forces. At each end of the shaft 102 is a respective stop 112, 114. These stops 112, 114 can vary greatly in shape and dimension without departing from the scope of the present invention. Each stop 112, 114 is typically larger than the outside diameter of the shaft 102 such that they prevent the socket drivers 104, 106 from becoming separated from the shaft 102.

The socket drivers 104, 106 are arranged around the shaft 102 and each has a square head 108, 110 that can engage a female socket opening. The shaft 102 can optionally have some type of groves or tracks 118 that help position the different socket drivers 104, 106.

Figure 3:
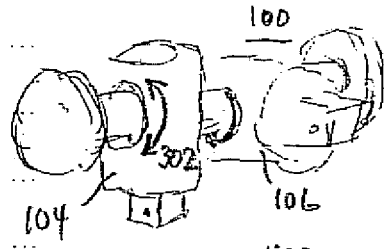
FIG. 3 depicts an isometric view of the socket wrench adapter of FIG. 1A in accordance with the principles of the present invention.

In operation, each of the socket drivers 104, 106 can slide along the major axis 116 of the shaft 102. As shown in FIG. 3, each of the socket drivers 104, 106 can also rotate around the major axis 116. The diameters of the socket drivers 104, 106 can be different or the same but are small enough to permit movement that allows each socket driver to travel to about the center of the shaft 102.

The term "socket driver" is being used as a label for the elements 104, 106. However, these elements 104, 106 can be other types of tool drivers as well. For example, the socket drivers 104, 106 can be shaped so as to drive different bits and other rotating tools. The principle at play is that the socket drivers 104, 106 can slide up and down the shaft 102 as well as rotate about the shaft 102. In this way, torque applied to one of the socket drivers 104, 106 is multiplied to rotate a tool coupled with the other socket driver 104, 106.

As for size, one exemplary configuration includes a shaft 102 that is about 2½ inches in length with a diameter of about ½ inch. However, as mentioned above other sizes are contemplated within the scope of the present invention.

Figure 1C:
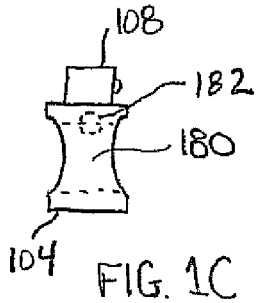
FIG. 1C depicts a socket driver in accordance with the principles of the present invention.
Figure 1B:
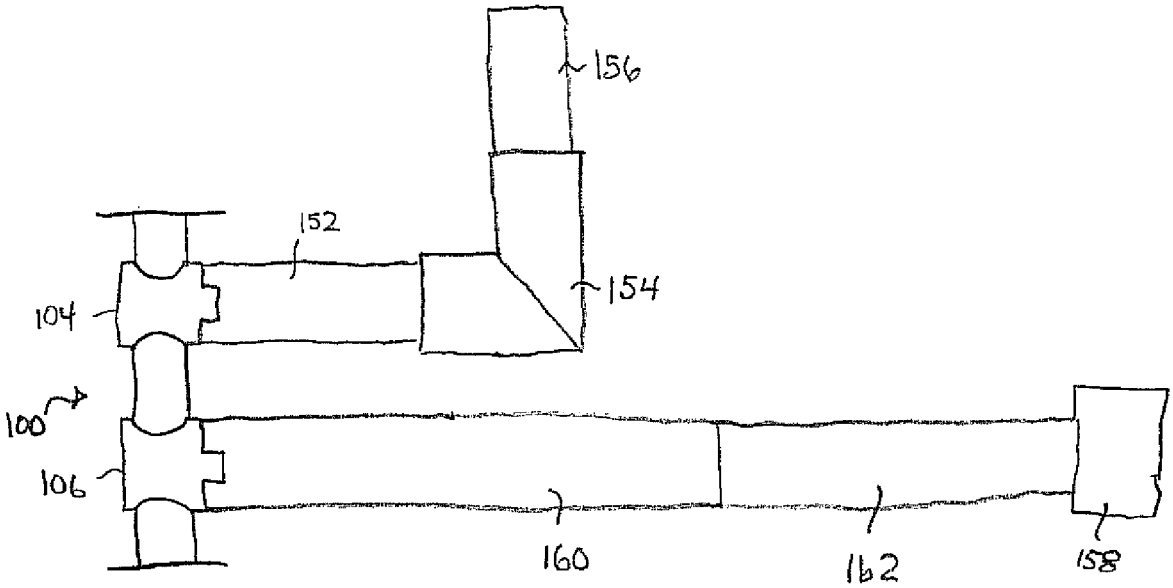
FIG. 1B depicts an exemplary configuration of using a socket wrench adapter in accordance with the principles of the present invention.

FIG. 1B depicts an exemplary configuration of using a socket wrench adapter in accordance with the principles of the present invention. This figure is provided to show an example of the wide variety of possible uses of embodiments of the present invention. By using socket drivers 104, 106 that have standard size square heads 108, 110, the socket and ratchet wrench accessories that a person already owns can be easily connected to the present adapter 100. Thus, one socket driver 104 can be coupled to an extension bar 152 and a knuckle joint 154 that itself is connected to another extension bar 156. At the other socket driver 106, one or more extension bars 160, 162 can be connected. A socket 158 of the appropriate dimension can be connected to the extension bar 162. In this way, pulling on the extension bar 156 in such a way as to rotate the adapter 100 to cause the socket 158 to rotate will multiply the torque delivered by the socket 158 as compared to the torque provided at the extension bar 156. One of ordinary skill will recognize that any of a variety of different sockets and adapters can be coupled with the adapter 100 without departing from the scope of the present invention.

FIG. 1C depicts a socket driver in accordance with the principles of the present invention. The socket driver 104 of FIG. 1C is a particular example of the type of socket driver which is encompassed within the present invention. In general, the socket driver will be able to rotate around the shaft 102 and also slide along the shaft 102. Thus, the socket driver 104 has a cylindrical opening 180 through the entire width of its body. It is this opening 180 through which the shaft 102 passes. If the shaft 102 has a different cross-sectional shape, then the opening 180 will be shaped in a complimentary fashion as well. A spring-biased ball 182 or some other detente may also be included within the opening 180. Such a detente will allow the socket driver 104 to engage one of the grooves 118 of the shaft 102. This engagement allows the socket driver 104 to be fixed in a particular position along the shaft 102 but also to be easily re-positioned as desired.

Figure 1D:
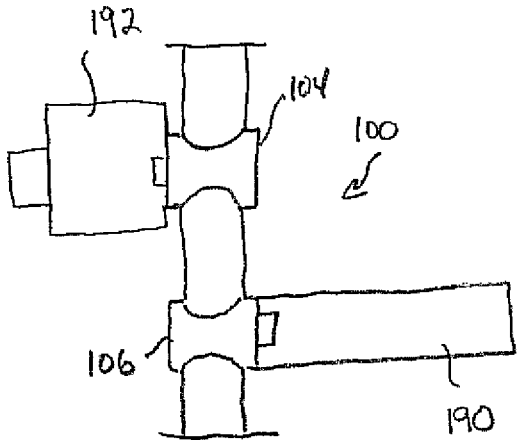
FIG. 1D depicts another exemplary configuration of using a socket wrench adapter in accordance with the principles of the present invention.

FIG. 1D depicts another exemplary configuration of using a socket wrench adapter in accordance with the principles of the present invention. In this configuration, a handle such as an extension bar 190 is attached to one socket driver 106 and an in-line ratchet mechanism 192 is attached to the other socket driver 104. The greater the distance between the socket drivers 104 and 106, the greater the torque multiplying effect there will be. As shown, the socket drivers 104, 106 are rotated so that the square heads are 180 degrees out of alignment. When the handle 190 is used to rotate the adapter 100 around the center-axis of the socket driver 104, the ratchet mechanism 192 can drive any tool it is connected to.

Figure 2:
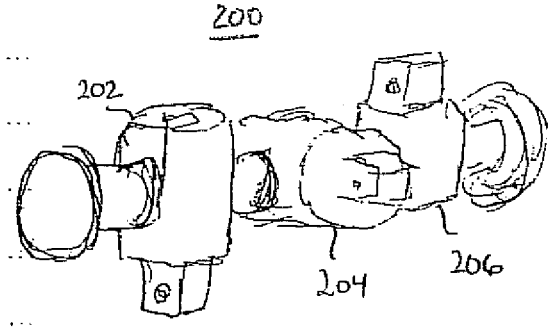
FIG. 2 depicts an alternative socket wrench adapter in accordance with the principles of the present invention.

FIG. 2 depicts an alternative socket wrench adapter 200 in accordance with the principles of the present invention. Embodiments of the present invention are not limited to an adapter having only two socket drivers; more than two can be useful to provide even a greater variety of possible tool configurations. If, for example, the socket drivers had different size square heads (e.g., ¼ inch, ⅜ inch, ½ inch, ¾ inch), then the adapter could be used with even more wrench accessories without alteration. In this particular alternative, the adapter 200 has three socket drivers 202, 204 and 206. As in the adapter 100 of FIG. 1A, each of the socket drivers 202, 204, 206 rotate about the central shaft and slide along the shaft as well.

FIG. 3 depicts an isometric view of the socket wrench adapter of FIG. 1A in accordance with the principles of the present invention. From this view, the circular rotation 302 of the socket drivers 104, 106 around the shaft 102 can more easily be appreciated. As mentioned, the square heads on the socket drivers 104, 106 can be the same size or can be different sizes.

Figure 4:
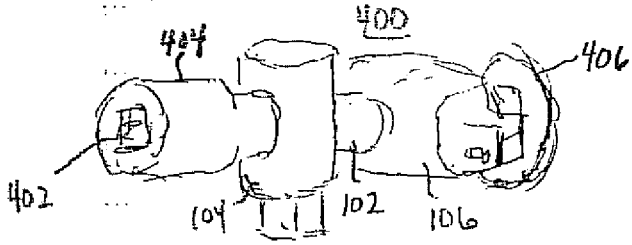
FIG. 4 depicts an alternative socket wrench adapter in accordance with the principles of the present invention.

FIG. 4 depicts an alternative socket wrench adapter in accordance with the principles of the present invention. This alternative adapter 400 includes one stop 404 that serves an additional purpose than keeping the socket drivers 104, 106 attached. The stop 404 can include a female (or male) socket adapter 402 that is inline with the major longitudinal axis of the shaft 102. The other stop 406 can be the same as the stops shown in FIG. 1A or could also be similar to the stop 404. For example, the stop 406 could have a male adapter while the stop 404 could have a female adapter as shown.

Figure 5:
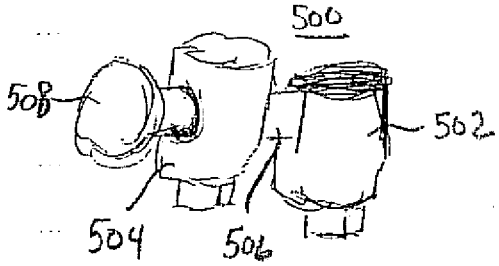
FIG. 5 depicts an alternative socket wrench adapter in accordance with the principles of the present invention.

FIG. 5 depicts an alternative socket wrench adapter in accordance with the principles of the present invention. The alternative adapter 500 can include only one rotating and sliding socket driver 504. The other socket driver 502 can be fixed to the shaft 506. One side effect of this configuration is that only one stop 508 is included in the adapter 500. The socket driver 504 continues to be slidable and rotatable around the shaft 506.

Figure 6A:
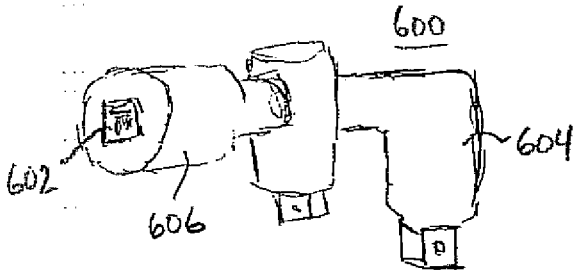
FIG. 6A depicts an alternative socket wrench adapter in accordance with the principles of the present invention.

FIG. 6A depicts an alternative socket wrench adapter in accordance with the principles of the present invention. The alternative adapter 600 is a combination of the features of FIG. 4 and FIG. 5 where one socket driver 604 is fixed and one of the stops 606 includes another socket adapter 602 that is inline with the axis of the shaft of the adapter 600.

Figure 6B:
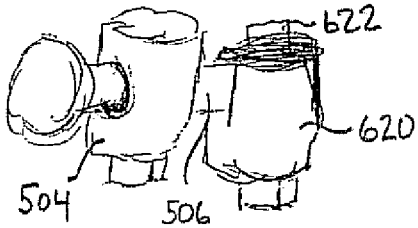
FIG. 6B depicts an alternative socket wrench adapter in accordance with the principles of the present invention.

FIG. 6B depicts an alternative socket wrench adapter in accordance with the principles of the present invention similar to that of FIG. 5. However, in a particular embodiment, the fixed socket driver 620 is a ratcheting mechanism 622 as well. The result would be similar to the configuration shown in FIG. 1D but the ratcheting mechanism socket driver 622 is already included in the adapter and securely affixed to the shaft 506. The term "ratcheting mechanism" is meant to include the type of ratcheting functionality that a typical ratchet handle for socket wrenches includes.

FIG. 7 depicts a lug nut accessory for a socket wrench in accordance with the principles of the present invention. Putting on and taking off lug nuts usually requires a significant amount of strength and for people to remember the correct rotation of the lug nut to tighten or loosen the nut. Also, using a traditional lug wrench requires working with your hands near the ground in many instances. Accordingly, embodiments of the socket wrench adapter of the present invention are configured to particularly help with installation and removal of lug nuts on an automobile tire. One of ordinary skill can appreciate, however, that the lug nut accessory can be used on other nuts than just lug nuts.

The lug nut accessory 700 includes two socket adapters 702, 704 on opposite ends of a shaft 710. In the middle of the accessory 700 is a step 706. The step 706 can be a fixed step or similar to a typical bicycle pedal that rotates around a horizontal axis. For ease of storage, the pedal 706 may be hinged or foldable so that a smaller accessory 700 can be created for storage.

The two socket adapters 702, 704 can be labeled "ON" and "OFF" because the accessory 700 when used with the socket adapter 100 can only be used to tighten lug nuts when the adapter 100 is connected to the "ON" socket 702 and can only be used to loosen lug nuts when the adapter 100 is connected to the "OFF" socket 704.

FIG. 8 shows one embodiment of a lug nut accessory 800 that works in conjunction with a socket wrench adapter 830 to remove and replace lug nuts. The socket wrench adapter 830 is similar to any of the adapters described in the earlier figures. There is a rotatable socket driver 806 and another rotatable socket driver 804 positioned along the shaft 802. The socket driver 806 couples with a socket 808 and the socket driver 804 couples with the lug nut accessory 800. The socket driver 806 could be a fixed driver that does not rotate but a socket 808 may need to be selected that is long enough to ensure clearance around the edge of a tire. Similarly, the socket driver 804 may be fixed as well such that it does not rotate about the shaft 802.

As for the lug nut accessory 800, there is a female "OFF" end 814 and a female "ON" end 812 at opposite ends of a shaft 810. The pedal 816 is attached to the shaft 810 such that it can slide 820 along the length of the shaft 810. The shaft 810 can vary greatly in length without departing from the scope of the present invention. For example, the shaft 810 could be 5 inches long or as long as 10 or 15 inches. The sliding of the pedal 816 allows the moment arm of the accessory 800 to me multiplied as needed.

Figure 9A:
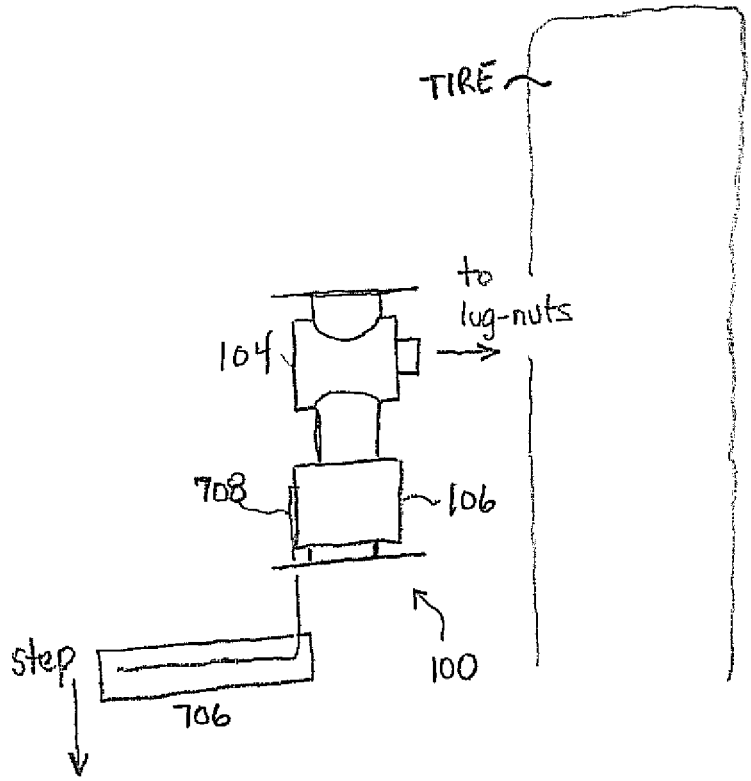
FIG. 9A and FIG. 9B illustrate operation of the lug nut accessory of FIG. 7 in accordance with the principles of the present invention.
Figure 9B:
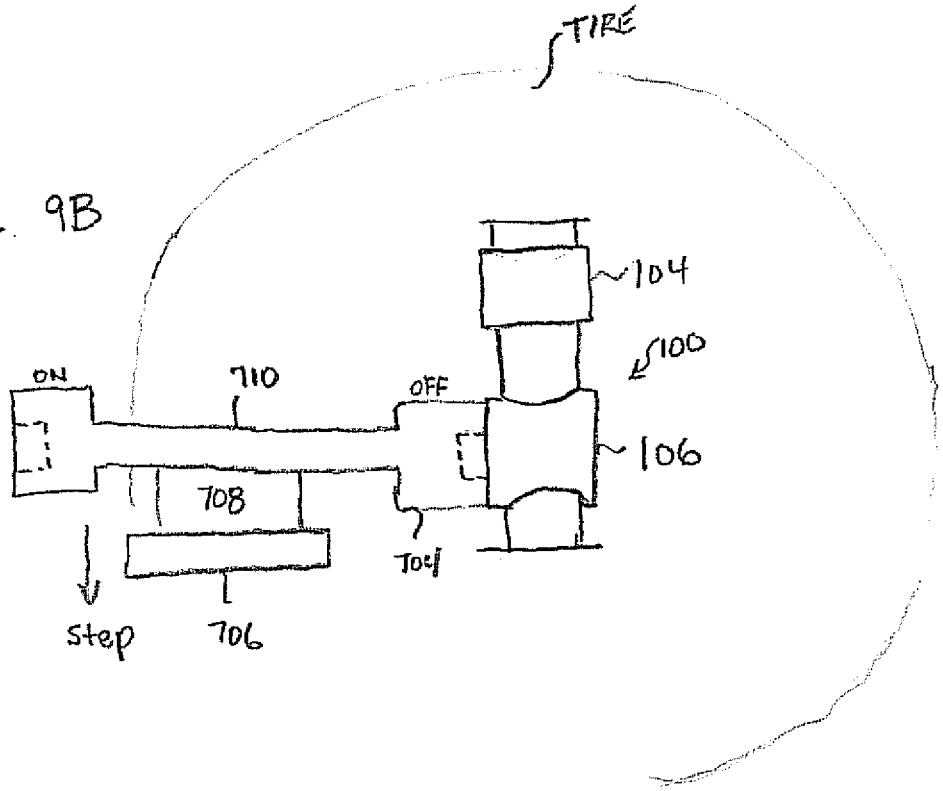

FIG. 9A and FIG. 9B illustrate operation of the lug nut accessory of FIG. 7 in accordance with the principles of the present invention. In these figures, the adapter 100 is connected to the "OFF" socket 704; however, similar but opposite rotation occurs if it were coupled with the "ON" socket 702.

In FIG. 9A the adapter 100 is oriented in a generally vertical direction with the socket driver 104 rotated so that its square head faces the tire lug nuts and the square head of socket driver 106 faces into the page (i.e., away from the viewer of this figure). The step 706 thus extends outwardly from the tire and the shaft 710 extends horizontally along the face of the tire. When someone steps down on the step 706, the force will be applied to the lug nut in a direction to break them free. FIG. 9B shows this configuration from a view facing the front of the tire.

Figure 10:
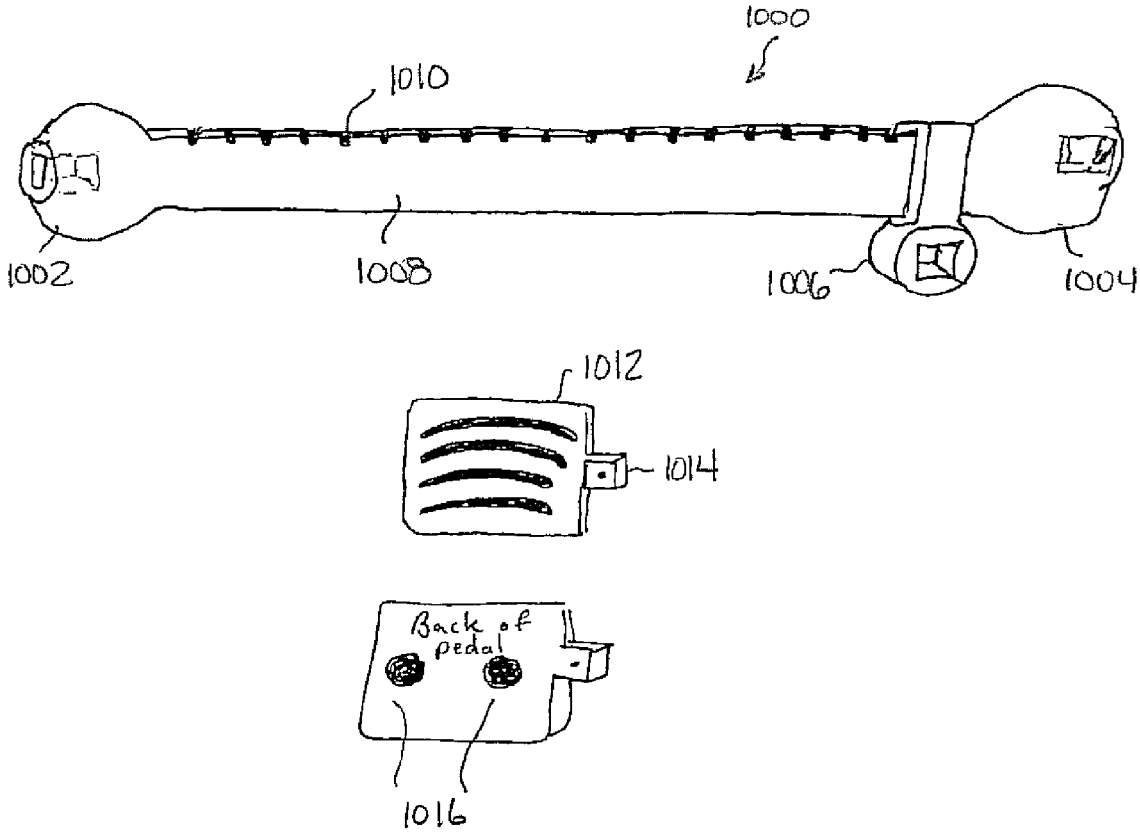
FIG. 10 depicts and alternative lug nut accessory for a socket wrench in accordance with the principles of the present invention.

FIG. 10 depicts another embodiment of a lug nut accessory 1000 in accordance with the principles of the present invention. The shaft 1008 is rectangular in cross-section and has notches 1010 notched along its length. Also, female ends 1002 and 1004 are on opposite ends of the shaft 1008. A pedal holder 1006 is moveable along the length of the shaft 1008 and has a shape to engage the notches 1010 so that it can be semi-securely positioned but easily moveable. The pedal holder 1006 has an opening in which a pedal 1012 can be inserted. In particular, the pedal 1012 can have a typical male socket end 1014 that fits an appropriately shaft female opening in the pedal holder 1006. Thus, the pedal can be removed to make a compact package for storage. Additionally, one or more magnets 1016 can be affixed to the rear of the pedal 1012 so that it sticks to the shaft 1008 which is made from a ferrous metal.

As mentioned previously, the example embodiments described herein use terms such as "square head", "socket driver", "socket adapter" and the like. These terms are used for the sake of clarity because they envision embodiments that can utilize current adapters and accessories that work with traditional socket wrenches and ratchet wrenches. However, these terms are also intended to encompass other type of connectors and coupling arrangements. For example, the "square head" functions to impart torque from the socket driver to a tool attached to the "square head". In practice, the "square head" is not necessarily required to be "square" but can be other shapes that effectively transfer torque to an attached tool. Similarly, the socket adapters and drivers do not necessarily need to function with existing sockets and socket types but can be shaped in a variety of different ways to provide similar functionality without departing from the scope of the present invention.

The previous description is provided to enable any person skilled in the art to practice the various embodiments described herein. Various modifications to these embodiments will be readily apparent to those skilled in the art, and the generic principles defined herein may be applied to other embodiments. Thus, the claims are not intended to be limited to the embodiments shown herein, but are to be accorded the full scope consistent with each claim's language, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A lug nut wrench comprising:

a first shaft having a first major longitudinal axis and a first shaft outside diameter;

a first stop at a first end of the first shaft, the first stop having a first stop outside diameter that is larger than the first shaft outside diameter;

a second stop at a second end of the first shaft opposite the first end, the second stop having a second stop diameter that is larger than the first shaft outside diameter;

a first socket driver attached to the first shaft and a second socket driver attached to the first shaft; wherein the first socket driver is positioned between the first stop and the second socket driver, and the second socket driver is positioned between the first socket driver and the second stop;

the first socket driver including a first opening through its body that is configured to allow the first socket driver to rotate around the first major longitudinal axis and to slide along the first major longitudinal axis;

the second socket driver including a second opening through its body that is configured to allow the second socket driver to rotate around the first major longitudinal axis and to slide along the first major longitudinal axis;

the first socket driver including a first square head extending from the first socket driver in a first direction orthogonal to the major longitudinal axis; and the second socket driver including a second square head extending from the second socket driver in a second direction orthogonal to the major longitudinal axis;

a second shaft having a second major longitudinal axis, the second shaft comprising:

a first socket adapter on a first end of the second shaft;

a second socket adapter on a second end of the second shaft opposite the first end of the second shaft; and a pedal attached to the second shaft and extending in a direction orthogonal to the second major longitudinal axis;

the first square head of the first socket driver configured to couple with either one of the first socket adapter and the second socket adapter, and the second square head of the second socket driver configured to concurrently couple with a socket, wherein the first square head and the second square head are orthogonally aligned such that a force applied to the pedal in a direction substantially aligned with the first major longitudinal axis causes the socket to rotate around a rotational axis that is substantially orthogonal to the second major longitudinal axis.

2. The lug nut wrench of claim 1, wherein when the first square head is coupled with the first socket adapter the socket rotates around the rotational axis in a first direction and when the first square head is coupled with the second socket adapter the socket rotates around the rotational axis in a second direction opposite from the first direction.

3. A lug nut wrench comprising:

a first shaft having a first major longitudinal axis and a first shaft outside diameter;

a first stop at a first end of the first shaft, the first stop having a first stop outside diameter that is larger than the first shaft outside diameter;

a second stop at a second end of the first shaft opposite the first end, the second stop having a second stop diameter that is larger than the first shaft outside diameter;

a first socket driver attached to the first shaft, wherein the first socket driver is positioned between the first stop and the second stop, wherein the first socket driver includes a first opening through its body for receiving the first shaft and configured to allow the first socket driver to rotate around the first major longitudinal axis of the first shaft and to slide along the first major longitudinal axis of the first shaft;

a second socket driver attached to the first shaft, wherein the second socket driver is positioned between the first socket driver and the second stop, wherein the second socket driver includes a second opening through its body for receiving the first shaft and configured to allow the first socket driver to rotate around the first major longitudinal axis of the first shaft and to slide along the first major longitudinal axis of the first shaft; and a second shaft having a second major longitudinal axis, the second shaft comprising:

a first socket adapter on a first end of the second shaft; and a pedal attached to the second shaft and extending in a direction orthogonal to the second major longitudinal axis;

wherein the first socket adapter of the second shaft is configured to couple to the first socket driver of the first shaft, and wherein the second socket driver is configured to concurrently couple to a socket.

4. The adapter of claim 3, further comprising:

a plurality of spaced-apart grooves around the first shaft between the first and second stops.

5. The adapter of claim 4, wherein the first socket driver includes a first détente configured to engage one of the plurality of grooves.

6. The adapter of claim 4, wherein the second socket driver includes a second détente configured to engage one of the plurality of grooves.

7. The lug nut wrench of claim 3, wherein the lug nut wrench is configured to cause the socket to rotate around a rotational axis that is substantially orthogonal to the first major longitudinal axis of the first shaft when:

the socket is coupled to the second socket driver, the first socket adapter of the second shaft is coupled to the first socket driver attached to the first shaft, the first longitudinal axis of the first shaft is positioned substantially orthogonal to the second longitudinal axis of the second shaft, and a force is applied to the pedal in a direction substantially parallel with the first major longitudinal axis.

8. The lug nut wrench of claim 7, wherein the first socket adapter of the second shaft is configured to couple to a square head of the first socket driver attached to the first shaft.

9. The lug nut wrench of claim 7, wherein the second shaft further comprises a second socket adapter on a second end of the second shaft opposite the first end of the second shaft, wherein the second socket adapter of the second shaft is configured to couple to the first socket driver attached to the first shaft, and wherein the lug nut wrench is configured to cause the socket to rotate around a rotational axis that is substantially orthogonal to the first major longitudinal axis of the first shaft when:

the socket is coupled to the second socket driver, the second socket adapter of the second shaft is coupled to the first socket driver attached to the first shaft, the first longitudinal axis of the first shaft is positioned substantially orthogonal to the second longitudinal axis of the second shaft, and a force is applied to the pedal in a direction substantially parallel with the first major longitudinal axis.

10. The lug nut wrench of claim 9, wherein the second socket adapter of the second shaft is configured to couple to a square head of the first socket driver attached to the first shaft.

11. The lug nut wrench of claim 9, wherein the socket is caused to rotate around the rotational axis of the socket in a first direction when a force is applied to the pedal and the first socket adapter of the second shaft is coupled to the first socket driver, and wherein the socket is caused to rotate around the rotational axis of the socket in a second direction when a force is applied to the pedal and the second socket adapter of the second shaft is coupled to the first socket driver, wherein the first direction is opposite the second direction.

12. The lug nut wrench of claim 3, wherein the first socket driver includes a female socket adapter or a male socket adapter.

13. The lug nut wrench of claim 3, wherein the second socket driver includes a female socket adapter or a male socket adapter.

14. The lug nut wrench of claim 3, further comprising the socket.

15. A lug nut wrench comprising:

a first shaft having a first major longitudinal axis and a first shaft outside diameter;

a first stop at a first end of the first shaft, the first stop having a first stop outside diameter that is larger than the first shaft outside diameter;

a second stop at a second end of the first shaft opposite the first end, the second stop having a second stop diameter that is larger than the first shaft outside diameter, wherein the second stop includes one of a female socket adapter and a male socket adapter;

a first socket driver attached to the first shaft, wherein the first socket driver is positioned between the first stop and the second stop, wherein the first socket driver includes a first opening through its body for receiving the first shaft and configured to allow the first socket driver to rotate around the first major longitudinal axis of the first shaft and to slide along the first major longitudinal axis of the first shaft; and a second shaft having a second major longitudinal axis, the second shaft comprising:

a first socket adapter on a first end of the second shaft; and a pedal attached to the second shaft and extending in a direction substantially orthogonal to the second major longitudinal axis, wherein the first socket adapter of the second shaft is configured to couple to one of the first socket driver attached to the first shaft or the socket adapter of the second stop of the first shaft.

16. The lug nut wrench of claim 15, wherein the lug nut wrench is configured to cause a socket to rotate around a rotational axis that is substantially orthogonal to the first major longitudinal axis of the first shaft when:

the socket is coupled to the first socket driver, the first socket adapter of the second shaft is coupled to the socket adapter of the second stop of the first shaft, the first longitudinal axis of the first shaft is positioned substantially orthogonal to the second longitudinal axis of the second shaft, and a force is applied to the pedal.

17. The lug nut wrench of claim 16, wherein the socket is caused to rotate when the force is applied to the pedal is in a direction substantially parallel with the first major longitudinal axis.

18. The lug nut wrench of claim 15, wherein the lug nut wrench is configured to cause a socket to rotate around a rotational axis that is substantially orthogonal to the first major longitudinal axis of the first shaft when:

the socket is coupled to the socket adapter of the second stop of the first shaft, the first socket adapter of the second shaft is coupled to the first socket driver attached to the first shaft, the first longitudinal axis of the first shaft is positioned substantially orthogonal to the second longitudinal axis of the second shaft, and a force is applied to the pedal.

19. The lug nut wrench of claim 18, wherein the socket is caused to rotate when the force applied to the pedal in a direction substantially parallel with the first major longitudinal axis.

20. The lug nut wrench of claim 18, wherein the socket is caused to rotate when the force applied to the pedal in a direction substantially orthogonal to the first major longitudinal axis.

* * * * *